US008353246B2

(12) United States Patent
Kamoda

(10) Patent No.: US 8,353,246 B2
(45) Date of Patent: Jan. 15, 2013

(54) QUALITY INSPECTION APPARATUS FOR SHEET-SHAPED MATTER

(75) Inventor: Hiroyoshi Kamoda, Noda (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 12/726,435

(22) Filed: Mar. 18, 2010

(65) Prior Publication Data

US 2010/0237560 A1 Sep. 23, 2010

(30) Foreign Application Priority Data

Mar. 19, 2009 (JP) ..... 2009-068120
Mar. 19, 2009 (JP) ..... 2009-068121
Mar. 19, 2009 (JP) ..... 2009-068122

(51) Int. Cl.
*B41F 1/30* (2006.01)
*B65H 83/00* (2006.01)

(52) U.S. Cl. ..... 101/408; 101/409; 101/410; 271/3.18; 271/3.19

(58) Field of Classification Search ..... 271/3.18, 271/3.19, 204; 101/408, 409, 410, 116, 120
See application file for complete search history.

(56) References Cited

U.S. PATENT DOCUMENTS 5,329,852 A 7/1994 Bolza-Schuenemann et al.
5,592,878 A * 1/1997 Eltner ..... 101/231
RE35,495 E * 4/1997 Bolza-Schuenemann et al. ..... 101/232
5,626,075 A * 5/1997 Detmers et al. ..... 101/232
6,176,482 B1 1/2001 Reinhard et al.
6,746,014 B2 * 6/2004 Endo et al. ..... 271/204
6,772,689 B2 * 8/2004 Endo et al. ..... 101/483
6,877,427 B2 * 4/2005 Dunninger et al. ..... 101/408
7,267,053 B2 * 9/2007 Beitel et al. ..... 101/232
2005/0127595 A1 6/2005 Hendle et al.
2009/0096156 A1 4/2009 Hendle et al.

FOREIGN PATENT DOCUMENTS

GB 2 023 547 A 1/1980
JP 3140190 B2 3/2001
JP 4057535 B2 3/2008

OTHER PUBLICATIONS

European Search Report issued in European Patent Application No. 10156283.3 on Dec. 23, 2011.

* cited by examiner

*Primary Examiner* — Kaitlin Joerger
(74) *Attorney, Agent, or Firm* — Birch, Stewart, Kolasch & Birch, LLP

(57) ABSTRACT

Provided is a quality inspection apparatus including: gripper units provided to each delivery chain, each gripper unit configured to hold an end portion of a sheet; an arc-shaped track portion provided in a part of a movement track of the gripper units and formed by the movement track; an inspection unit installed at an opposite side of the arc-shaped track portion from an arc center of the arc-shaped track portion; and a vacuum cylinder installed at the same side of the arc-shaped track portion as the arc center. In the apparatus, while running along the arc-shaped track portion, the sheet is inspected by the inspection unit under a guidance of the vacuum cylinder.

9 Claims, 11 Drawing Sheets

QUALITY INSPECTION APPARATUS FOR SHEET-SHAPED MATTER

BACKGROUND OF THE INVENTION

1. Field of the Invention

The present invention relates to a quality inspection apparatus for a sheet-shaped matter such as a sheet printed by an intaglio printing press.

2. Description of the Related Art

As for an intaglio printing press used to print bank notes, securities, and the like, it is a generally known practice that an inspection unit or the like provided upstream of a delivery point inspects the quality of printed matters printed by a printing apparatus (printing unit) immediately before the printed matters are delivered to a delivery apparatus (delivery unit).

For example, Patent Literature 1 discloses a sheet-fed rotary printing press including: gripper beams which are guided by chains, and which support grippers; and a gripper beam track which is arranged to be doubled in an upper-lower direction and which allows the gripper beams to make round trips therein. In this sheet-fed rotary printing press, a suction box having a flat suction surface facing the upper-side movement track is installed above the upper-side movement track of the grippers, whereas an optical/electronic camera system for printing quality control is installed right below the suction box and under the lower-side movement track of the grippers.

In addition, Patent Literature 2 discloses a sheet conveyance apparatus including: a vacuum-type sheet guiding element; at least one gripper system which grips the front edge of a sheet; and an inspection system which includes an optical scan system and the like. The sheet guiding element has a sheet guiding surface. The sheet guiding surface of the sheet guiding element extends approaching a conveyance plane surface of the gripper system in a conveyance direction. The sheet guiding surface of the sheet guiding element is curved into an arc with a radius Ra in the conveyance direction. A travelling path in the conveyance direction of the front edge of the sheet clamped by the gripper system is curved into an arc with a radius Rg. The two arcs cross each other at one point. The inspection system is installed to face the sheet guiding surface.

CITATION LIST

Patent Literature

[Patent Literature 1] Japanese Patent No. 3140190
[Patent Literature 2] Japanese Patent No. 4057535

SUMMARY OF INVENTION

Technical Problem

Nevertheless, the sheet-fed rotary printing press disclosed in Patent Literature 1 has a problem that a sheet has a non-sucked portion partially generated without being entirely sucked to the flat suction surface because the sheet is guided on the flat track of the gripper beam by the suction box which also has the flat suction surface, and which is installed to be directed downward.

Furthermore, the sheet conveyance apparatus described in Patent Literature 2 has a problem that the inspection system can include only a limited number of inspection units (exactly speaking, cameras) in limited locations because the inspection system is placed in a location opposed to the sheet guiding surface curved into the arc, i.e., at a side where the center of the arc (center of curvature) is located. In addition, the travel trace of the gripper system is situated between the sheet guiding surface and the center of the arc (center of curvature) of the fixed vacuum-type sheet guiding element which is curved into the arc. Thus, the sheet conveyance apparatus has another problem of needing to be provided with a device (relief structure or the like) for avoiding interference between the sheet guiding element and the gripper system to allow sheets to run stably, which in turn causes an increase in cost due to complication of the structure.

In view of the above problems, an object of the present invention is to provide a quality inspection apparatus for a sheet-shaped matter, which allows the sheet-shaped matter to run stably, which also has a high flexibility in arrangement of inspection units, and which is capable of quality inspection with high precision.

Solution to Problem

In order to achieve the above object, a quality inspection apparatus for a sheet-shaped matter according to the present invention includes: sheet-shaped matter holding units provided to each endless conveyance body, and configured to hold an end portion of a sheet-shaped matter; an arc-shaped track portion provided to a part of a movement track of the sheet-shaped matter holding units; a guide installed at a same side of the arc-shaped track portion as an arc center; and an inspection unit installed at an opposite side of the arc-shaped track portion from the arc center of the arc-shaped track portion, wherein while running along the arc-shaped track portion, the sheet-shaped matter is inspected by the inspection unit under a guidance of the guide.

The quality inspection apparatus for a sheet-shaped matter includes a plurality of inspection units.

In the quality inspection apparatus for a sheet-shaped matter, the guide is a rotationally driven rotary guide body having such a diameter that a circumferential surface of the rotary guide body has a substantially equal curvature to that of the arch-shaped track portion, the rotary guide body configured to cause the sheet-shaped matter to stick to the circumferential surface by suction.

In the quality inspection apparatus for a sheet-shaped matter, the rotary guide body is rotationally driven by an exclusive driving unit.

The quality inspection apparatus for a sheet-shaped matter further includes adjustment means configured to adjust a circumferential speed of the rotary guide body.

The quality inspection apparatus for a sheet-shaped matter further includes: sheet information inputting means configured to input various kinds of information on the sheet-shaped matter; and control means configured to control the driving unit on a basis of an input signal from the sheet information inputting means.

In the quality inspection apparatus for a sheet-shaped matter, the guide is a fixed suction guide having an arc-shaped suction surface in a part of its circumferential surface, the arc-shaped suction surface having a substantially equal curvature to that of the arc-shaped track portion and configured to cause the sheet-shaped matter to stick to the arc-shaped suction surface by suction.

In the quality inspection apparatus for a sheet-shaped matter: the arc-shaped track portion is installed to be convex toward an inside of a loop formed by the movement track in order that the arc center of the arc-shaped track portion is positioned outside the loop; the guide is installed outside the loop; and the inspection unit is installed inside the loop.

In the quality inspection apparatus for a sheet-shaped matter,: the arc-shaped track portion is installed to be convex toward an outside of the loop formed by the movement track in order that the arc center of the arc-shaped track portion is positioned inside the loop; the guide is installed inside the loop; and the inspection unit is installed outside the loop.

Advantageous Effects of Invention

The quality inspection apparatus for a sheet-shaped matter according to the present invention allows the sheet-shaped matter to run stably by using a guiding surface extending along an arc-shaped track portion which is provided in a part of a movement track in a sheet-shaped holding unit. In addition, the apparatus also allows any number and any arrangement locations of inspection units to be set as needed, and is capable of quality inspection with high precision.

BRIEF DESCRIPTION OF DRAWINGS

FIGS. 11A-11D are explanatory diagrams of other patterns for setting up the inspection section and the like.

DETAIL DESCRIPTION OF THE INVENTION

A quality inspection apparatus for a sheet-shaped matter according to the present invention will be described in detail on the basis of the respective examples with reference to the drawings.

EXAMPLE 1

Figure 1:
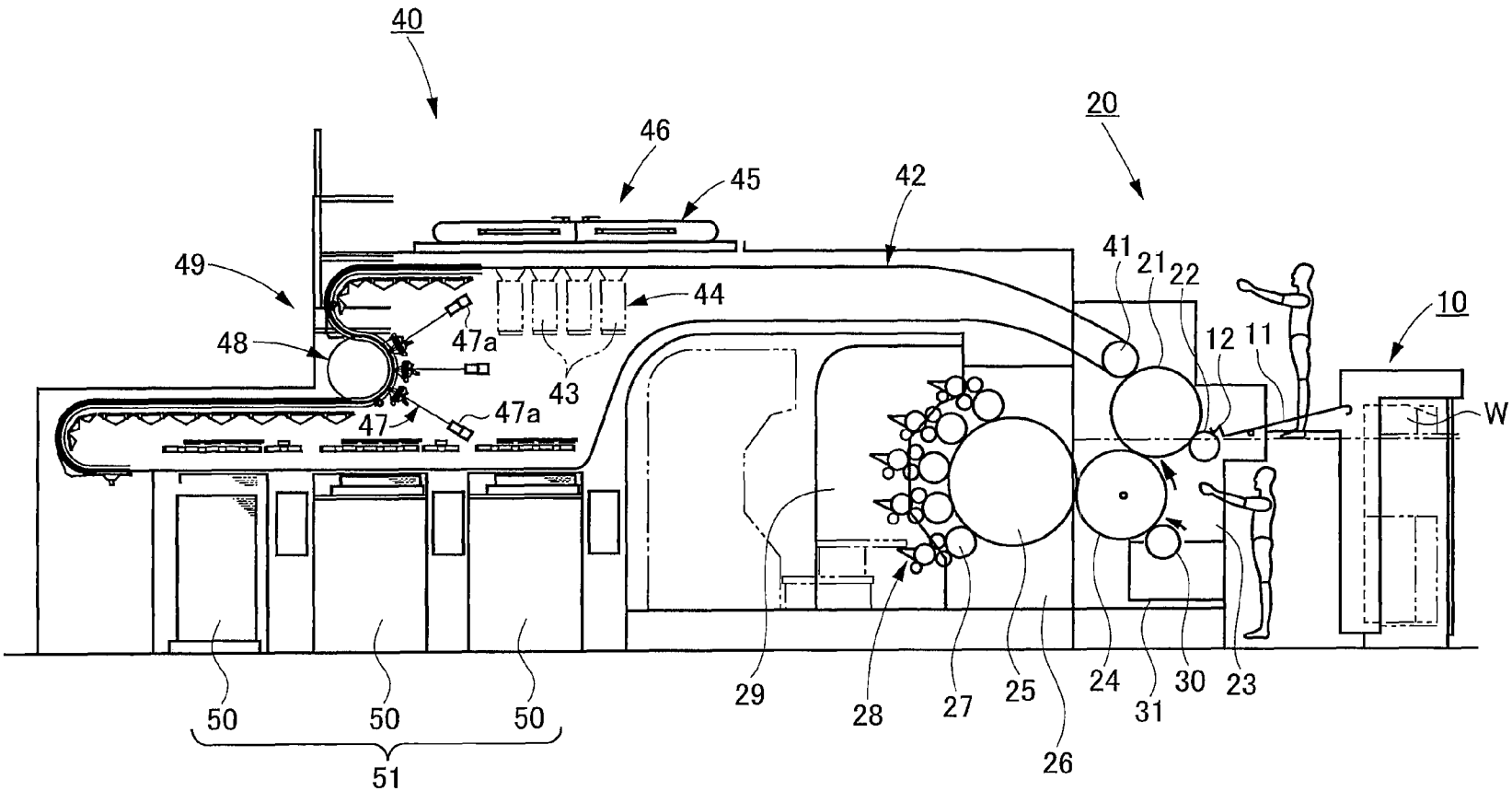
FIG. 1 is an overall configuration diagram of an intaglio printing press shown as Example 1 of the present invention.
Figure 2:
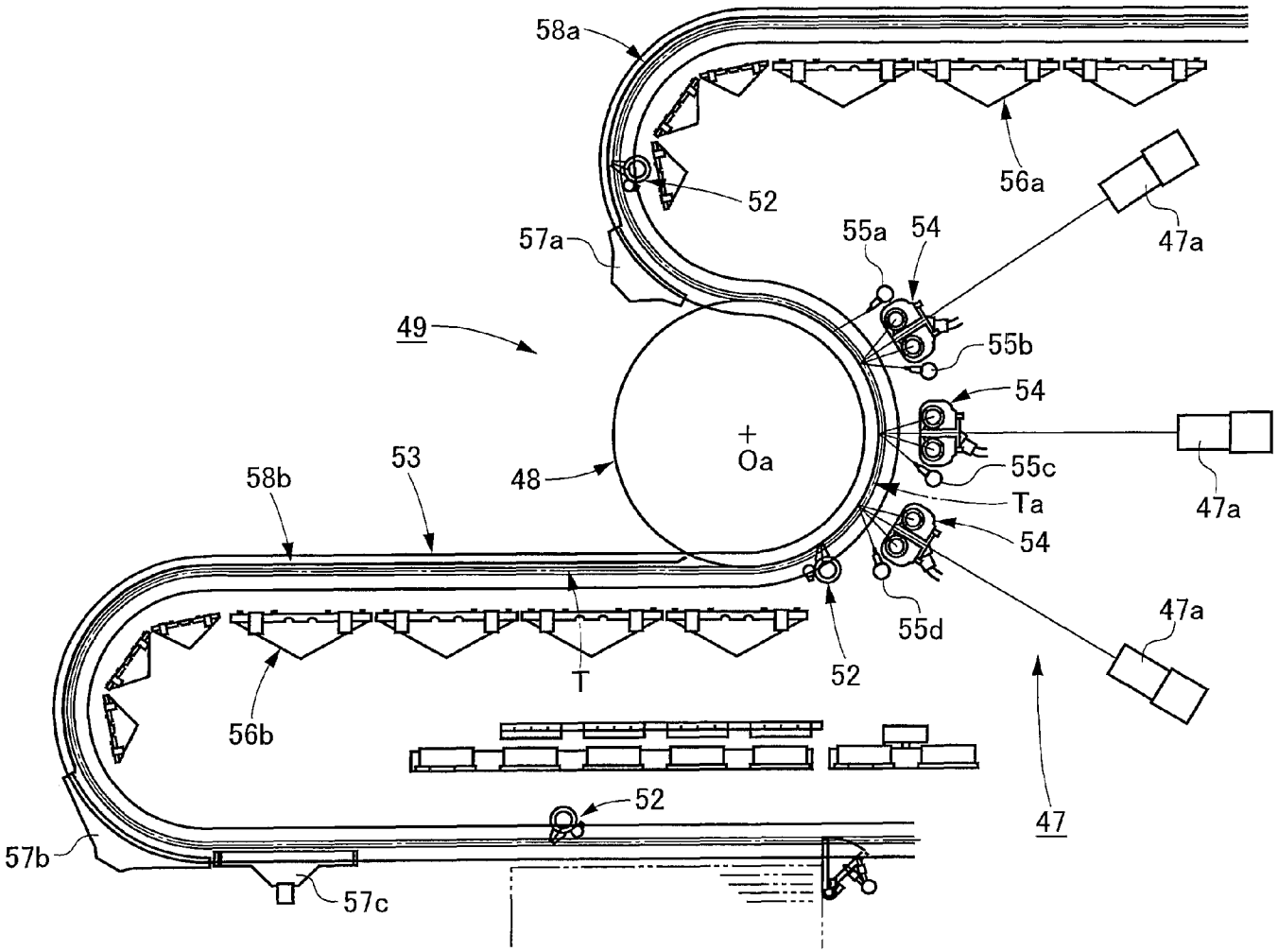
FIG. 2 is a detailed drawing of an inspection section.
Figure 3:
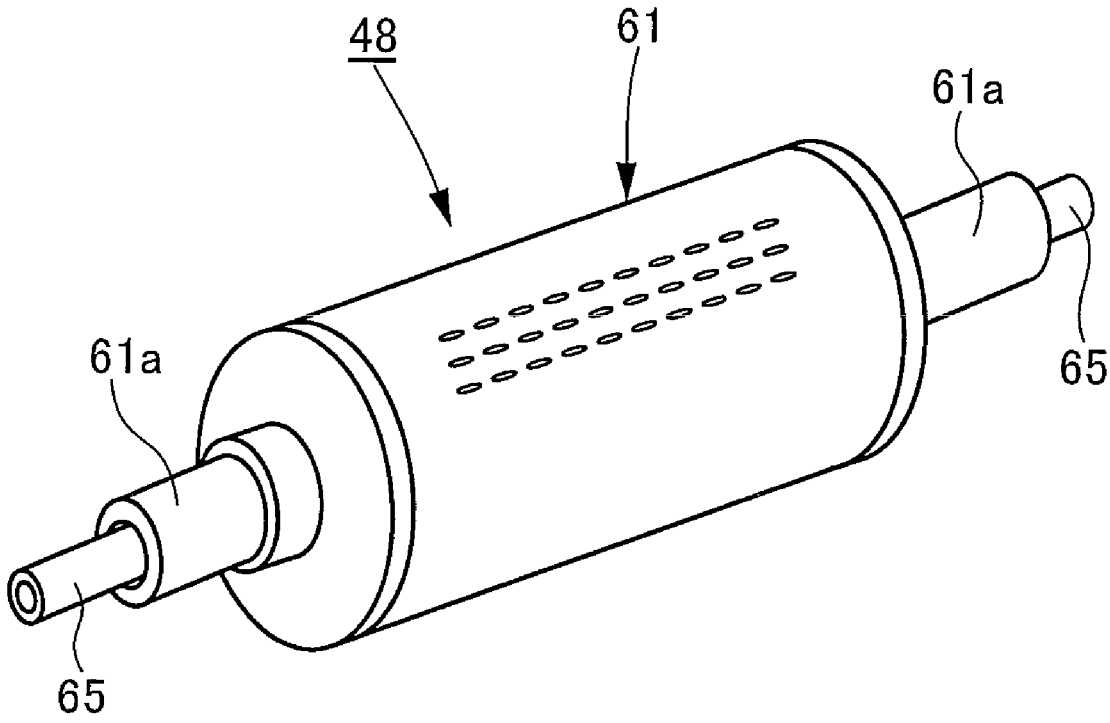
FIG. 3 is a perspective view of a vacuum cylinder.
Figure 4:
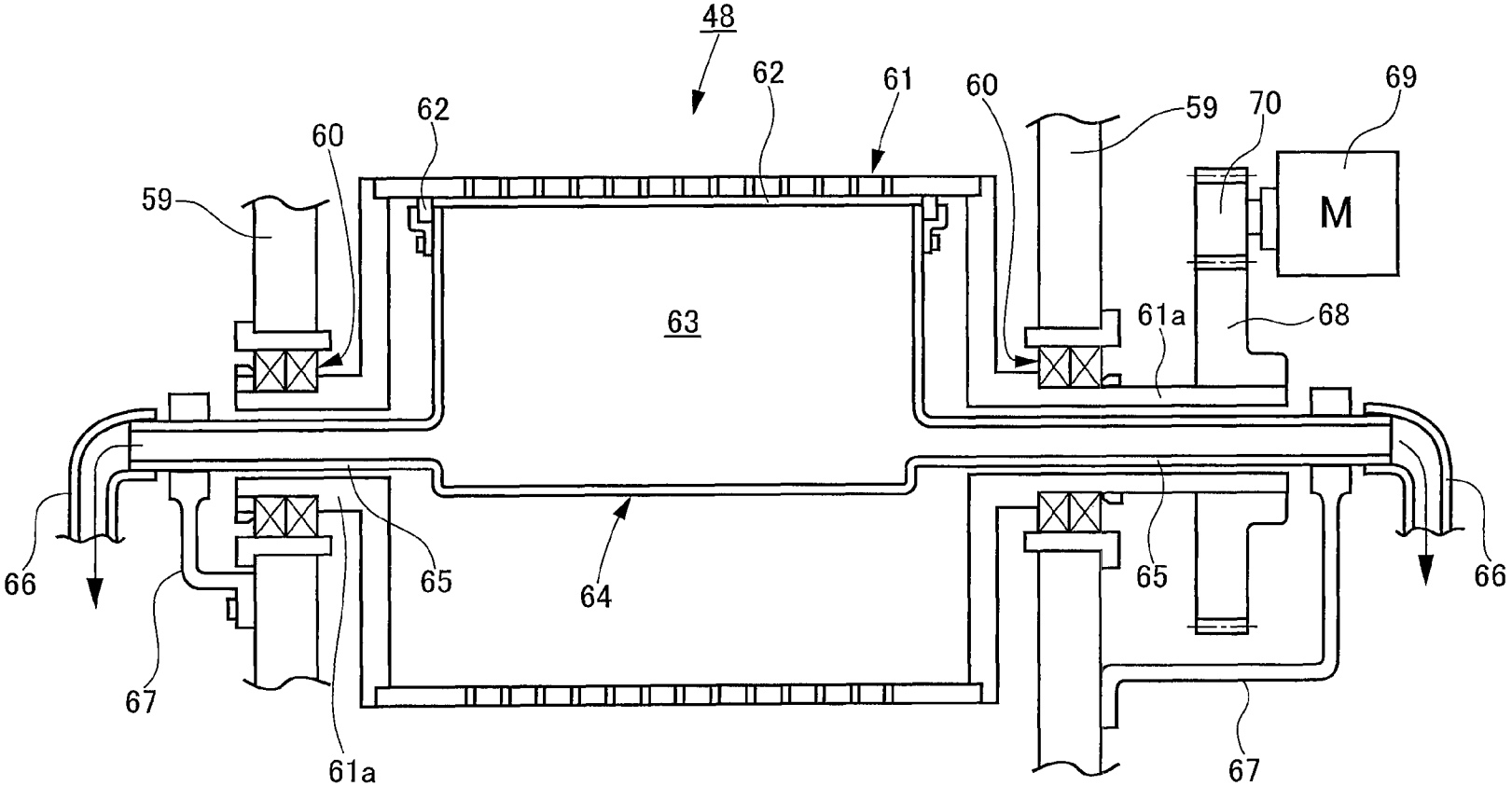
FIG. 4 is a front cross-sectional view of the vacuum cylinder.
Figure 5:
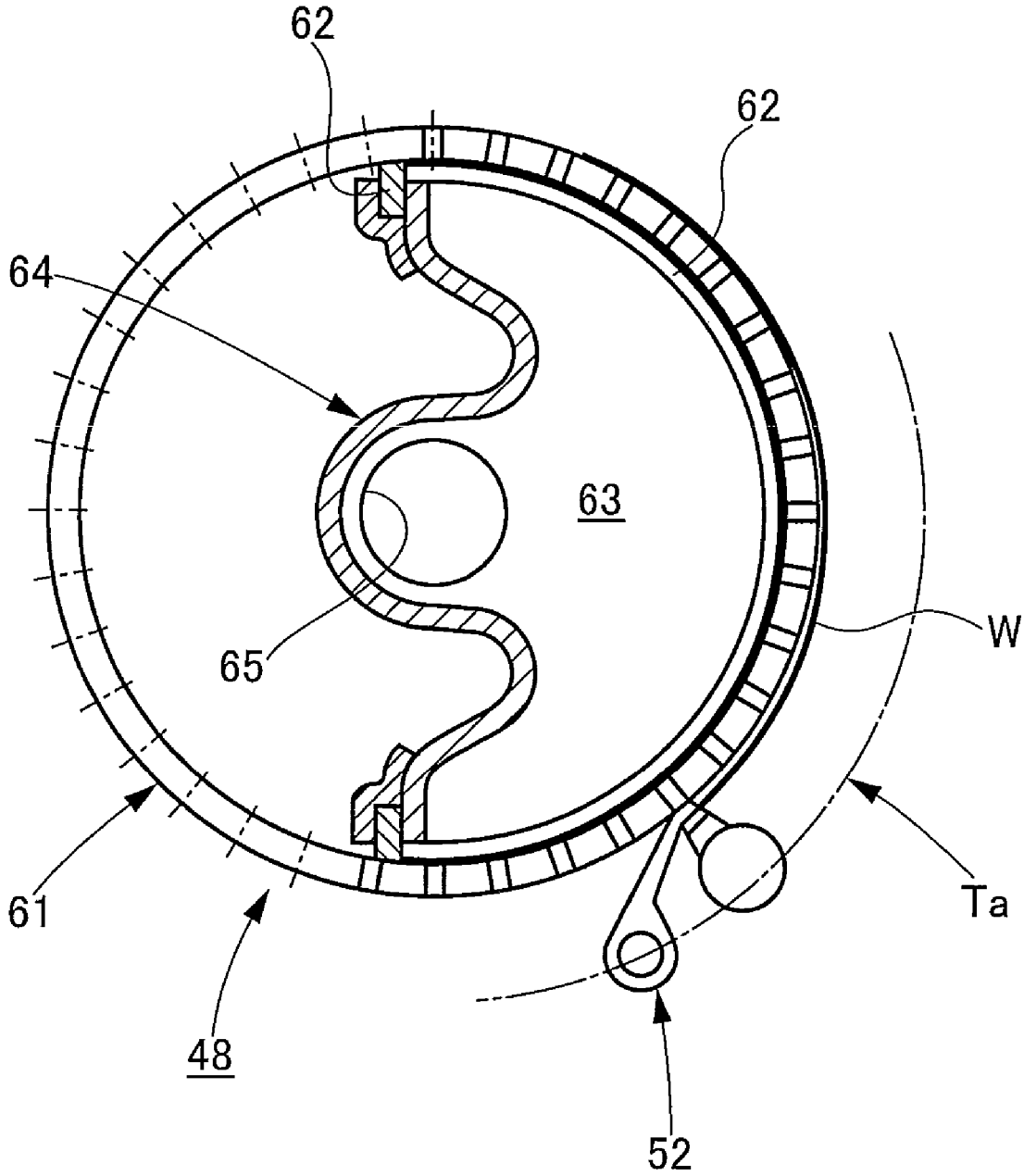
FIG. 5 is a side cross-sectional view of the vacuum cylinder.
Figure 6:
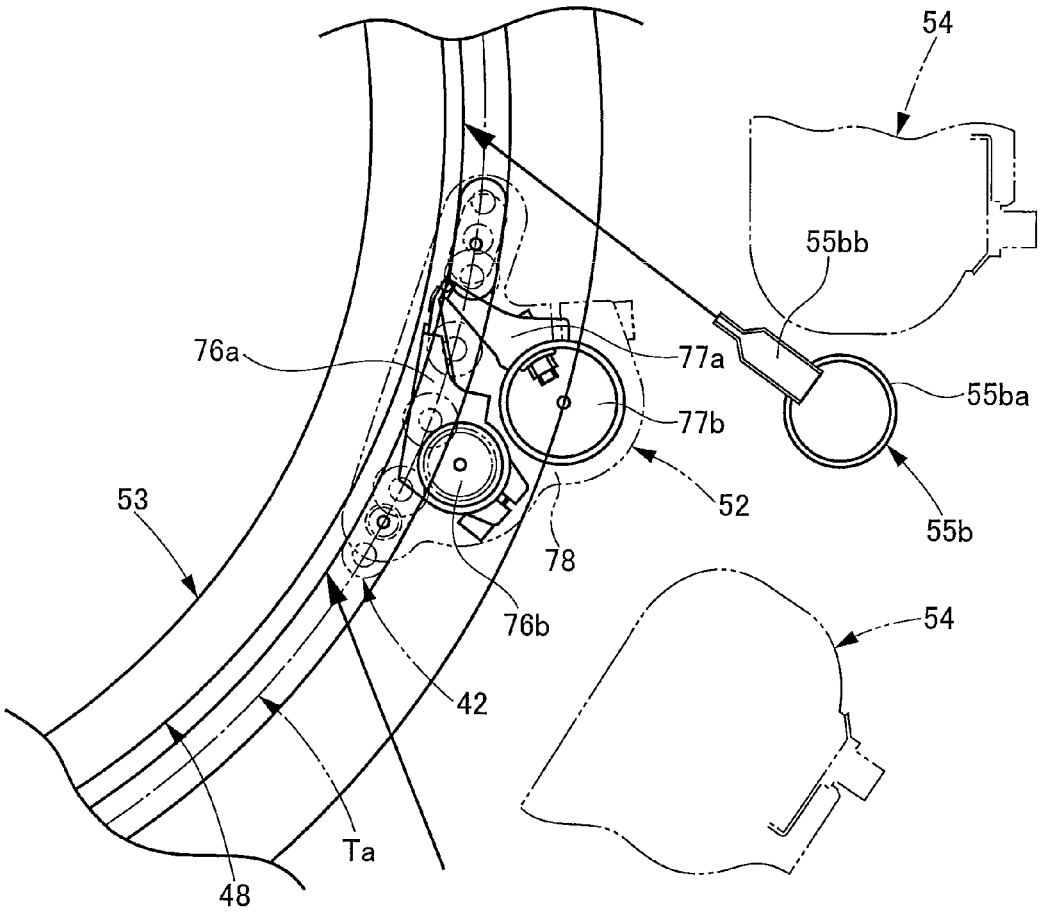
FIG. 6 is an explanatory diagram of a delivery chain and a gripper unit.
Figure 7:
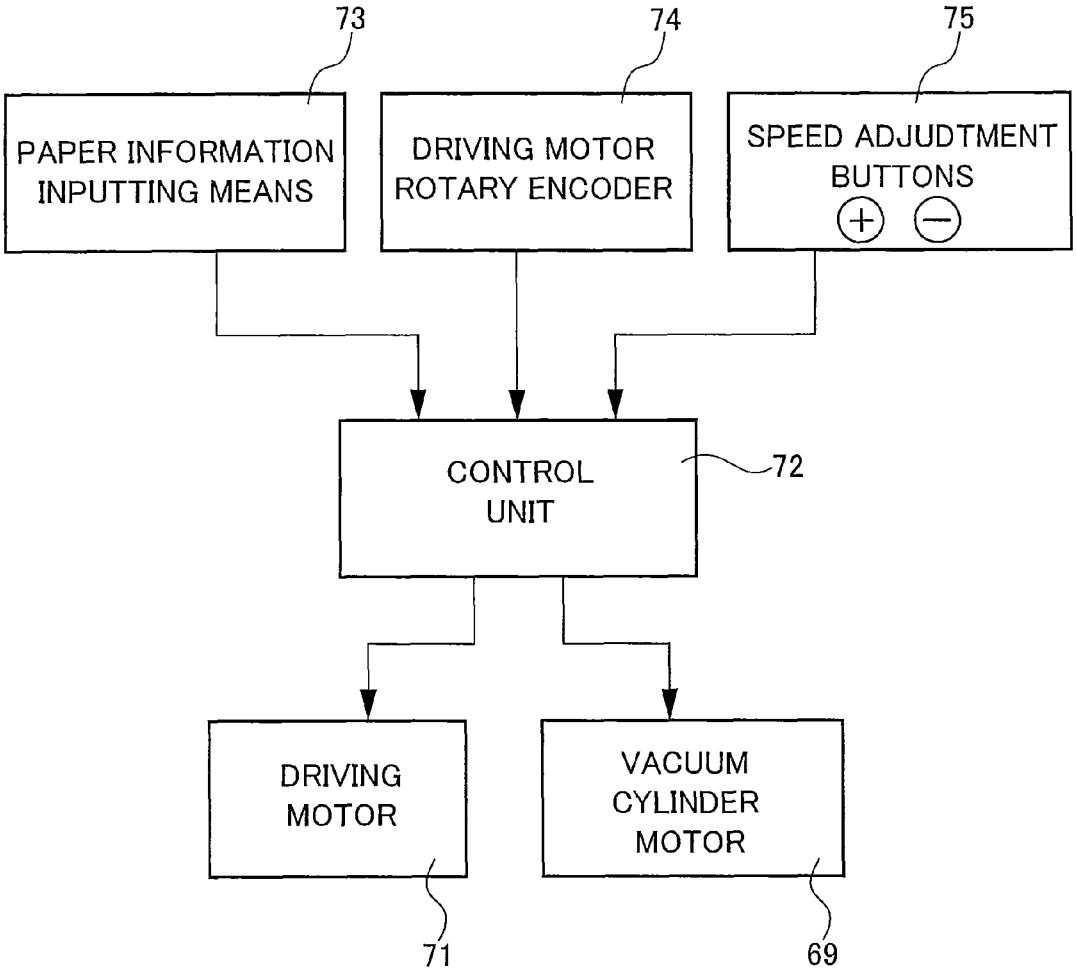
FIG. 7 is a control block diagram of a driving unit.

FIG. 1 is a diagram of an overall configuration of an intaglio printing press shown as Example 1 of the present invention; FIG. 2 is a detailed drawing of an inspection section; FIG. 3 is a perspective view of a vacuum cylinder; FIG. 4 is a front cross-sectional view of the vacuum cylinder; FIG. 5 is a side cross-sectional view of the vacuum cylinder; FIG. 6 is an explanatory diagram of a delivery chain and a gripper unit; and FIG. 7 is a control block diagram of a driving unit.

As shown in FIG. 1, an intaglio printing press mainly includes a feeding apparatus (sheet-shaped matter supplying apparatus) 10, a printing apparatus 20 and a delivery apparatus (sheet-shaped matter discharging unit) 40.

The feeding apparatus 10 is loaded with sheets (sheet-shaped matters) W. A feedboard 11 communicates with the feeding apparatus 10. The feedboard 11 receives sheets W which are sent out from the top of the stack of sheets W by a sucker mechanism on a one-by-one basis. Upon reception of each sheet W, the feedboard 11 registers the sheet W. A swing arm shaft pre-gripper 12 is disposed next to the feedboard 11. The swing arm shaft pre-gripper 12 grips a sheet W situated on the feedboard 11, and swings with the sheet W being gripped.

In the printing apparatus 20, an impression cylinder 21 communicates with the swing arm shaft pre-gripper 12 with a transfer cylinder 22 being interposed therebetween. The impression cylinder 21 is so-called a triple-size cylinder. Three grippers can be placed on the impression cylinder at equal intervals in the circumferential direction, and three rubber-made blankets can be mounted to the impression cylinder 21. The impression cylinder 21 is supported by a frame 23. The transfer cylinder 22 includes grippers which are similar to the grippers of the impression cylinder 21. Thus, the grippers of the transfer cylinder 22 are configured to be capable of: gripping a sheet W from the swing arm shaft pre-gripper 12 in turn; and subsequently causing the grippers of the impression cylinder 21 to grip the sheet W in turn.

A plate cylinder 24 is in contact with the impression cylinder 21. The plate cylinder 24 is so-called a triple-size cylinder. Three intaglio plates can be mounted on the plate cylinder 24 in the circumferential direction. The plate cylinder 24 is supported by the frame 23. An ink collecting cylinder 25 is in contact with the intaglio plates of the plate cylinder 24. The ink collecting cylinder 25 is so-called a quadruple-size cylinder. Four rubber-made blankets are mounted on the ink collecting cylinder 25 in the circumferential direction. The ink collecting cylinder 25 is supported by a frame 26. Five chablon rollers 27 are in contact with this ink collecting cylinder 25 in a way that the five chablon rollers 27 are arranged one after another in the circumferential direction. Each chablon roller 27 is so-called a monobloc roller. The circumferential length of each chablon roller 27 corresponds to the length of each blanket of the impression cylinder 21 and the length of each intaglio plate of the plate cylinder 24. Each chablon roller 27 is supported by the frame 26. Inking devices 28 are in contact with the respective chablon rollers 27. The inking devices 28 supply their respective inks. Each inking devices 28 are supported by a frame 29. Inks whose colors are different from one another are filled in the respective inking devices 28.

As described above, the ink collecting cylinder 25 is the quadruple-size cylinder. Although the inking collecting cylinder 25 is very large, the inking collecting cylinder 25 is capable of being fully supported. That is because: the five chablon rollers 27 and the five inking devices are placed next to the ink collecting cylinder 25; and the ink collecting cylinder 25 and the chablon rollers 27 are supported by the frame 26 which is independent of the other frames.

In this respect, if the ink collecting cylinder 25 is a triple-size cylinder, only four chablon rollers 27 and four inking devices 28 can be placed. If the ink collecting cylinder 25 is a quintuple-size or larger-size cylinder, the apparatus as a whole is too bulky. For these reasons, the quadruple-size cylinder is appropriate for the ink collecting cylinder 25. Furthermore, if the plate cylinder 24 is a double-size or smaller-size cylinder, it is difficult to install a wiping roller 30, which will be described later, and the like. If the plate cylinder 24 is a quadruple-size or larger-size cylinder, the apparatus is too bulky. For these reasons, the triple-size cylinder is appropriate for the plate cylinder 24. Moreover, if the impression cylinder 21 and the plate cylinder 24 have different diameters, sheets W are likely to be printed out of register. For this reason, it is appropriate that the impression cylinder 21 should be the same triple-size cylinder, i.e., should have the same diameter as the plate cylinder 24.

The wiping roller 30 is in contact with the intaglio plates of the plate cylinder 24. This wiping roller 30 is soaked in a wiping tank 31 containing a cleaning fluid.

In the delivery apparatus 40, a delivery cylinder 41 is in contact with the impression cylinder 21. Although not illustrated, paired sprockets are coaxially provided to the delivery cylinder 41. Delivery chains (endless conveyance bodies) 42 are endlessly wound around the paired sprockets, respectively. A drying section 46, an inspection section 49 and a delivery section 51 are placed sequentially from the upstream to downstream in a running direction of these delivery chains 42. In the drying section 46, multiple dryers 44 (four dryers 44 in the illustrated case) and vacuum tables 45 are installed in a way that the multiple dryers 44 are opposed to the vacuum tables 45 with the delivery chains 42 being interposed therebetween. Each dryer 44 includes a UV lamp 43 and the like. In the inspection section 49, an inspection unit 47 and a vacuum cylinder 48 are installed in a way that the inspection unit 47 is opposed to the vacuum cylinder 48 with the delivery chains 42 being interposed therebetween. The inspection unit 47 includes multiple CCD-line cameras (three CCD-line cameras) 47*a* and the like. In the delivery section 51, three delivery piles 50 are installed together. Note that, although described later, each delivery chain 42 is provided with gripper units (sheet-shaped matter holding units) 52 at equal intervals (see FIGS. 2 and 6).

In the inspection section 49, as shown in FIG. 2, an arc-shaped track portion (inwardly arc-shaped track portion) Ta is provided to a part of a movement track of each delivery chain 42 which runs under the guide of the a corresponding guide rail (chain guide) 53, in other words, a part of a movement track T of the gripper units 52. The arc-shaped track portion Ta is curved like the letter S, and thus projects toward the inside of a loop (closed space) formed by the movement track T. In other words, the arc center Oa of the arc-shaped track portion Ta is positioned outside the loop. In addition, the inspection unit 47 is installed in an opposite side of the arc-shaped track portion Ta from the arc center Oa of the arc-shaped track portion Ta, i.e., inside the loop. On the other hand, the vacuum cylinder 48 is installed at the same side of the arc-shaped track portion Ta as the arc center Oa, i.e., outside the loop.

The inspection unit 47 includes the three CCD-cameras 47*a*, sources of light, and four air-blowing nozzles 55*a* to 55*d*. The three CCD-cameras 47*a* are arranged radially around the arc-shaped track portion Ta. The sources of light are LED illuminators, and are installed paired with the respective CCD-line cameras 47*a*. The four air-blowing nozzles 55*a* to 55*d* are installed around the arc-shaped track portion Ta at any intervals, and blow air to sheets W which run along the arc-shaped track portion Ta. Note that, in FIG. 2, reference signs 56*a*, 56*b* denote air-blowing guides; 57*a* to 57*c* denote vacuum guides; and 58*a*, 58*b* denote sheet guide plates.

As shown in FIGS. 3 to 5, the vacuum cylinder 48 includes a porous cylindrical body 61 and a partition wall 64. The porous cylindrical body 61 is rotatably supported by a frame 59 with a bearing 60 being interposed between its cylinder shaft parts 61*a* and the frame 59. The circumferential surface of the porous cylindrical body 61 has a diameter in which the curvature of the circumferential surface is substantially equal to that of the arc-shaped track portion Ta. The partition wall 64 is housed in this porous cylindrical body 61. The partition wall 64 together with a seal member 62 defines a negative-pressure chamber 63. Negative pressure introducing pipes 65 extend out from the two sides of this partition wall 64, and penetrate the respective cylinder shaft parts 61*a*, thus projecting to the outside. Thereafter, the negative pressure introducing pipes 65 communicate with a source of negative pressure (a vacuum pump or the like) with a pipe 66 being interposed between the source of negative pressure and each of the negative pressure introducing pipes 65. In addition, the negative pressure introducing pipes 65 are supported by the frame 59 with a bracket 67 being interposed between the frame 59 and each of the negative pressure introducing pipes 65. Openings of the negative-pressure chamber 63 are opposed to the front surface of each sheet W which runs along the arc-shaped track portion Ta.

On the other hand, a gear 68 is fastened to one of the cylinder shaft parts 61*a*. An output gear 70 of a vacuum cylinder motor (driving unit) 69 is in mesh with this gear 68. In addition, the circumferential speed of the vacuum cylinder 48 (exactly speaking, the porous cylindrical body 61) is designed to be adjustable, and can be changed to a circumferential speed which is appropriate to the speed of the sheet W.

To put it specifically, as shown in FIG. 7, the drive of the vacuum cylinder motor (driving unit) 69 together with the drive of a driving motor (primary driving unit) 71 is controlled by control unit (control means) 72. A signal is inputted into the control unit 72 from each of paper information inputting means (sheet information inputting means) 73, a driving motor rotary encoder 74, and speed adjustment buttons (adjustment means) 75. The paper information inputting means 73 is configured to input information on a thickness of the sheet W, information on a material of the sheet W, and the like. The driving motor rotary encoder 74 is configured to detect a speed of the driving motor 71. The speed adjustment buttons (adjustment means) 75 are respectively configured to increase and decrease a circumferential speed of the vacuum cylinder 48 relative to the sheet W which run.

In each gripper unit (gripper bar) 52, as shown in FIG. 6, a gripper pad shaft 77*b* is laid between paired brackets 78. A gripper shaft 76*b* and multiple gripper pads 77*a* are fastened to the gripper pad shaft 77*b*. The gripper shaft 76*b* supports multiple grippers 76*a* in a way that the multiple grippers 76*a* are capable of opening and closing (rotating). The brackets 78 are connected to the delivery chains 42 which run under the guidance of the guide rails 53, respectively.

FIG. 6 shows each of the four air-blowing nozzles 55*a* to 55*d* that are obtained by installing multiple cylindrical nozzles 55*bb* on a nozzle header 55*ba*. However, each air-blowing nozzle 55*a* may be obtained by forming many nozzle holes in a pipe, or may be obtained by forming a slit in the pipe.

In this intaglio printing press, sheets W are sent out from the feeding apparatus 10 to the top of the feedboard 11 on a one-by-one basis. Thereafter, each sheet W goes through the swing arm shaft pre-gripper 12 and the transfer cylinder 22. Subsequently, the sheet W is transferred to the grippers of the impression cylinder 21, and the grippers of the impression cylinder 21 grip the sheet W. Afterward, the sheet W is conveyed while gripped by the grippers of the impression cylinder 21. On the other hand, inks are transferred from the inking devices 28 to the ink collecting cylinder 25 via the chablon rollers 27, respectively. Thereby, the inks are supplied to top surfaces of the intaglio plates. Excessive portions of the respective inks are removed by the wiping roller 30. The sheet W goes through the interstice between the impression cylinder 21 and the plate cylinder 24. Thereby, the inks are transferred to the sheet W, and the sheet W is thus printed. After that, the printed sheet W is conveyed by the delivery chains 42 of the delivery apparatus 40 after going through the delivery cylinder 41. Subsequently, the sheet W is delivered to the top of a predetermined one of the delivery piles 50.

In this example, in the inspection section 49 in the delivery apparatus 40, while the sheet W runs along the arc-shaped track portion Ta provided to a part of the movement track T of the gripper units 52, the sheet W is inspected by the inspection unit 47 under the suction guidance of the vacuum cylinder 48 (exactly speaking, the porous cylindrical body 61) having a diameter in which the curvature of the circumferential surface of the vacuum cylinder 48 is substantially equal to that of the arc-shaped track portion Ta.

During the inspection, the sheet W is conveyed stably, because: air is blown to the front surface of the sheet W from the four air-blowing nozzles 55*a* to 55*d*; and the porous cylindrical body 61 is rotationally driven at the circumferential speed which is appropriate to the speed of the sheet W. In addition, the porous cylindrical body 61 is placed at the same side of the arc-shaped track portion Ta as the arc center (curvature center) Oa. This placement allows the front ends of the respective grippers 76*a* in each gripper unit 52 to be placed as close to the suction surface of the porous cylindrical body 61 as possible. This enables the sheet W to move along with the porous cylindrical body 61 while being in close contact with the suction surface of the porous cylindrical body 61, and enables the porous cylindrical body 61 to revolve in a location free from interfere with the grippers 76*a*. For this reason, no problem takes place even when the circumferential speed of the porous cylindrical body 61 is changed relative to the speed of the sheet W.

Moreover, the inspection unit 47 is placed at the opposite side of the arc-shaped track portion Ta from the arc center Oa of the arc-shaped track portion Ta. For this reason, in a case where the arc-shaped track portion Ta is formed in a way that the arc-shaped track portion Ta projects toward the inside of the loop as in the example, for instance, the multiple CCD-line cameras 47*a* (the three CCD-line cameras in the illustrated example) and the like can be placed in compact inside the loop (closed space), which is formed by the movement track T of the gripper units 52, with no restriction. This allows different types of inspection to be effectively carried out. Furthermore, in the illustrated example, the CCD-cameras 47*a* can be placed horizontally. This placement is effective for protecting the camera lenses from foreign particles and duct.

As a result, the quality of printed sheets W can be inspected with high precision.

EXAMPLE 2

Figure 8:
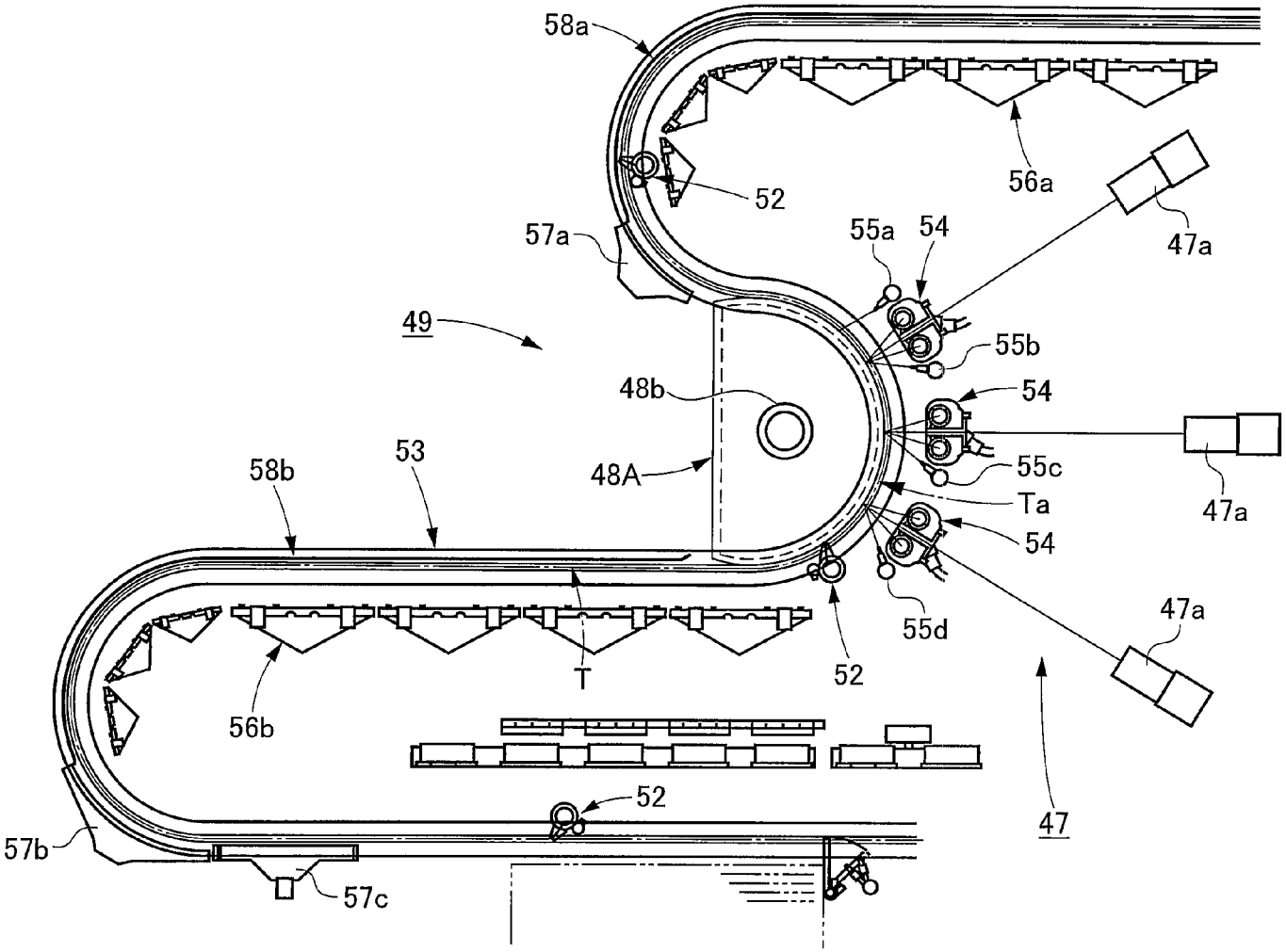
FIG. 8 is a detailed diagram of an inspection section as Example 2 of the present invention.
Figure 9:
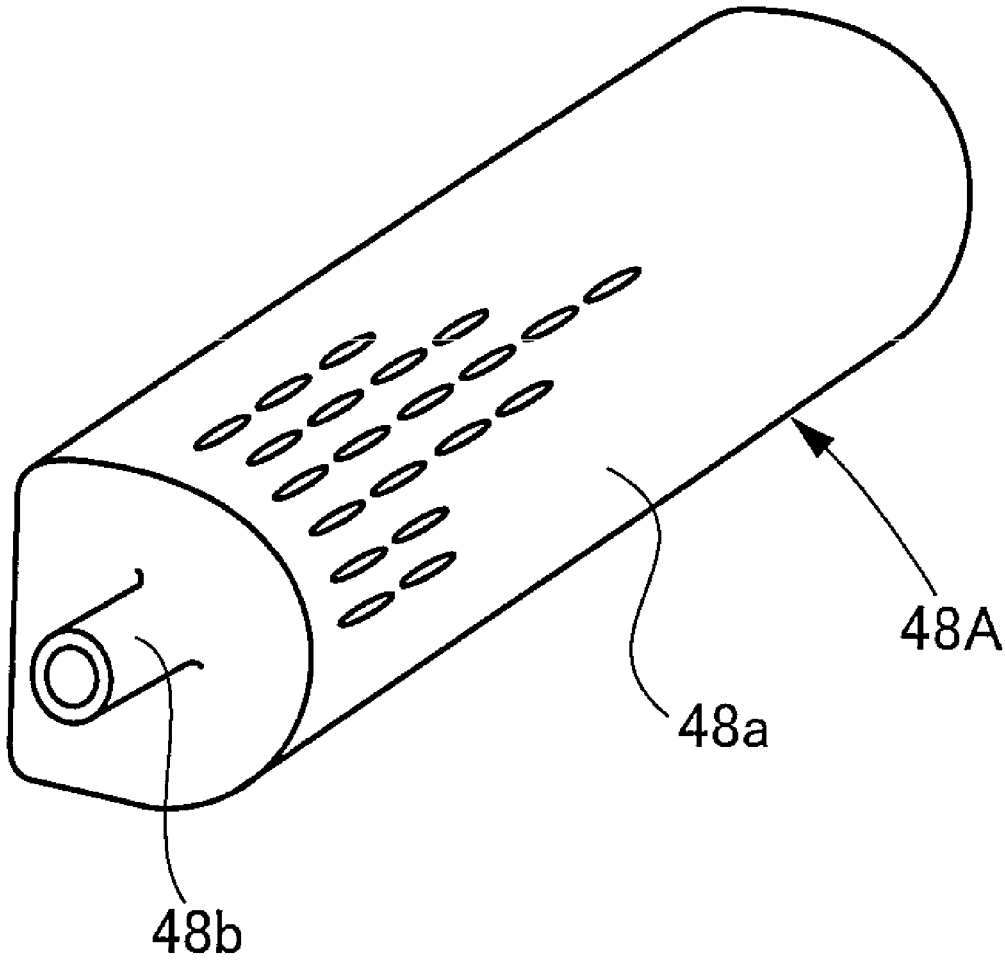
FIG. 9 is a perspective view of a suction box.

FIG. 8 is a detailed diagram of an inspection section as Example 2 of the present invention. FIG. 9 is a perspective view of a suction box.

This is an example in which, instead of the vacuum cylinder 48 of Example 1, a fixed suction guide 48A is used in a part of the arc-shaped track portion Ta in the inspection section 48. The fixed suction guide 48A has an arc-shaped suction surface 48*a* which is configured to cause each sheet W to stick to a part of its circumferential surface by suction. The curvature of the arc-shaped suction surface 48*a* is substantially equal to that of the arch-shaped track portion Ta. In FIG. 9, reference sign 48*b* denotes one of negative-pressure introducing pipes which extend out from the respective two sides of the fixed suction guide 48A. The fixed suction guide 48A is designed to be fixed to the frame 59 (see FIG. 4) by the negative-pressure introducing pipes 48*b*. The rest of the configuration of Example 2 is the same as the rest of the configuration of Example 1. For this reason, duplicated descriptions will be omitted.

Operation and working effects which are the same as those of Example 1 can be obtained from Example 2, except that the fixed suction guide 48A is not rotationally driven.

EXAMPLE 3

Figure 10:
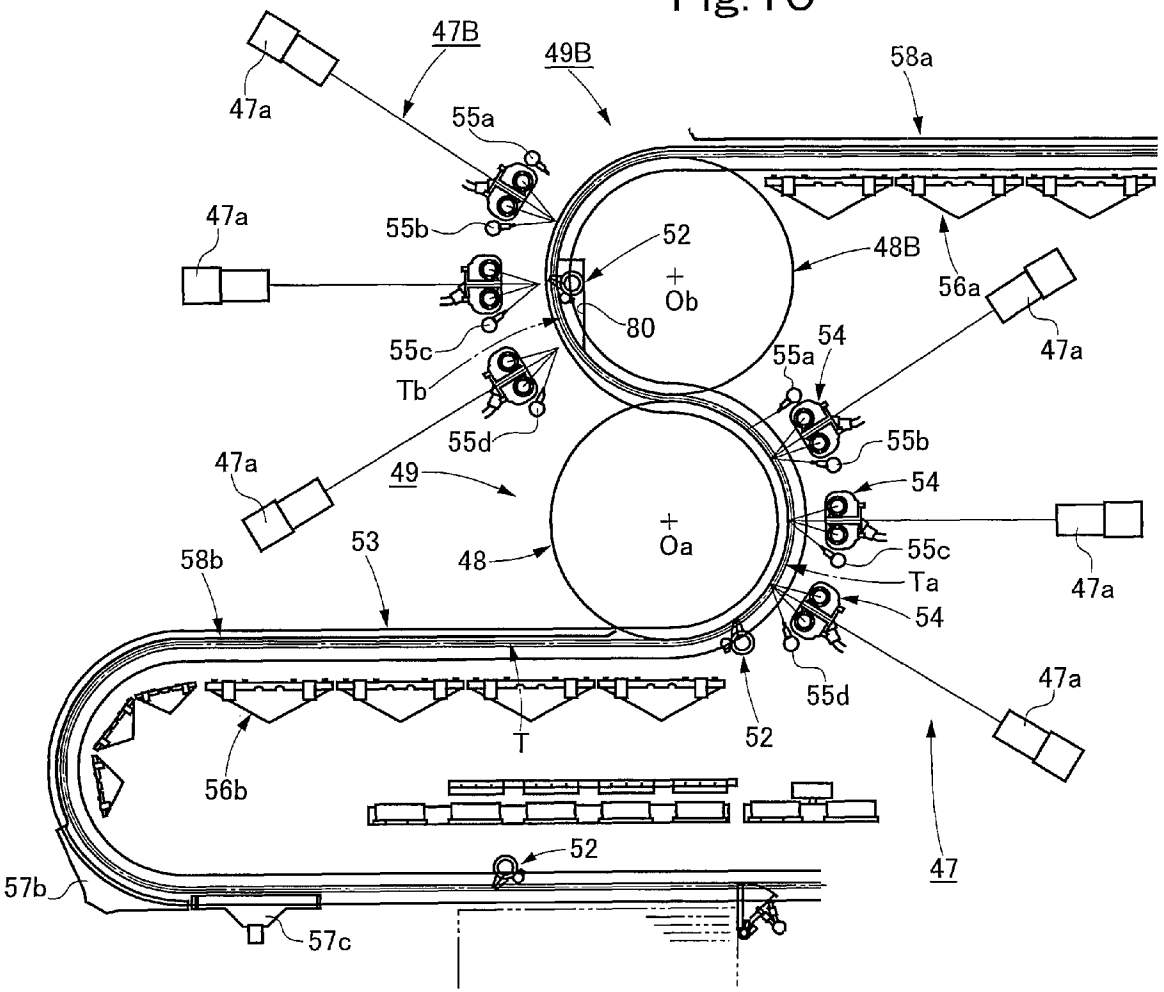
FIG. 10 is a detailed diagram of an inspection section, shown as Example 3 of the present invention.
Figure 11A:
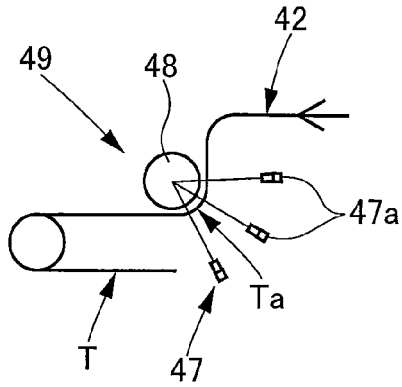
Figure 11B:
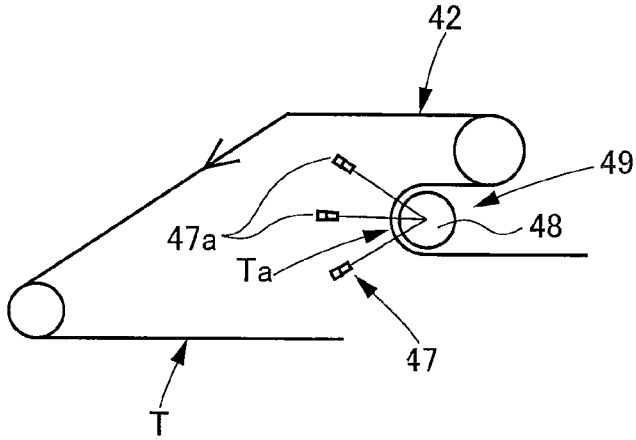
Figure 11C:
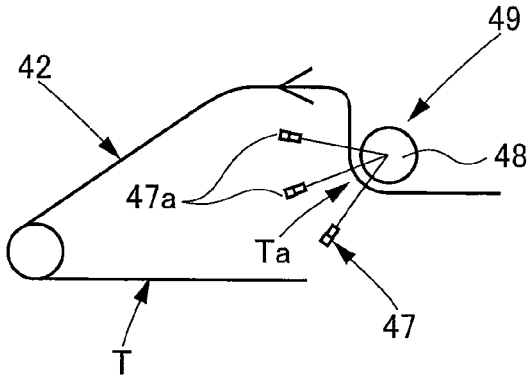
Figure 11D:
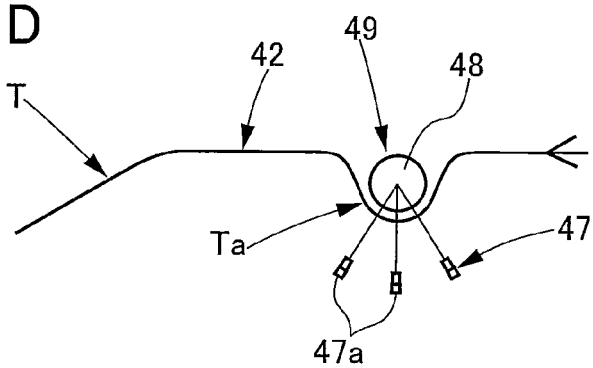

FIG. 10 is a detailed diagram of an inspection section shown as Example 3 of the present invention.

This is an example in which an inspection section 49B is additionally provided to the other (upper) arc-shaped track portion (outwardly arc-shaped track portion) Tb. A positional relationship of an inspection unit (external inspection unit) 47B and a vacuum cylinder (internal guide) 48B to their corresponding arc-shaped track potion is reverse to the positional relationship of the inspection unit 47 and the vacuum cylinder 48 to their corresponding arc-shaped track portion in the inspection section 49 which is situated under the inspection section 49B. In other words, the inspection unit 47B is placed at an opposite side of the arc-shaped track portion Tb from an arc center Ob of the arc-shaped track portion Tb (or outside the loop), whereas the vacuum cylinder 48B is placed at the same side of the arc-shaped track portion Tb as the arc center Ob side (or inside the loop). In this case, notches 80, which gripper units 52 are capable of entering, are formed in the outer circumference of the vacuum cylinder 48B. The rest of the configuration of this example is the same as the rest of the configuration of Example 1. For this reason, duplicated descriptions will be omitted.

In addition to the operation and working effects which are the same as those of Example 1, the following advantage can be obtained from this example. Specifically, the inspection sections 49, 49B at the two locations enable multiple inspections whose types are more different from each other to be carried out. In other words, for example, multiple CCD-line cameras (three CCD-line cameras in the illustrated case) 47*a* and the like can be placed in compact, too, outside the loop (closed space), which is formed by the movement track T of the gripper units 52, with no restriction. For this reason, this example is capable of effectively carrying out inspections whose types are different from each other.

Note that, instead of the vacuum cylinders 48, 48B, the fixed suction guides 48A of Example 2 may be used for the foregoing example.

Note that it goes without saying that: the present invention is not limited to the above-described examples; and the present invention can be variously modified within the scope not depart from the gist of the present invention. For example, for the inspection section 49 and the like, various placement patterns as shown in FIGS. 11A to 11D can be conceived as those other than the foregoing placement patterns. Furthermore, instead of the delivery chains 42, belts may be used as the endless conveyance bodies. Instead of the guide rails (chain guides) 53, sprockets may be used as the guide unit for the endless conveyance bodies.

INDUSTRIAL APPLICABILITY

The quality inspection apparatus according to the present invention can be preferably used as an intaglio printing press for printing bank notes, securities, and the like.

REFERENCE SINGS LIST

40 delivery apparatus
42 delivery chain
47*a* CCD-line camera
47 inspection unit

48 vacuum cylinder
48A fixed suction guide
48*a* arc-shaped suction surface
49 inspection section
52 gripper unit
53 guide rail
W sheet
T movement track of gripper units
Ta arc-shaped track portion
Oa arc center

The invention claimed is:

1. A quality inspection apparatus for a sheet-shaped matter comprising:

sheet-shaped matter holding units provided to each endless conveyance body, and configured to hold an end portion of a sheet-shaped matter;

an arc-shaped track portion provided to a part of a movement track of the sheet-shaped matter holding units;

a guide installed at a same side of the arc-shaped track portion as an arc center, the guide including a circumferential surface having a substantially equal curvature to that of the arc-shaped track portion; and at least one inspection unit installed at an opposite side of the arc-shaped track portion from the arc center of the arc-shaped track portion, the at least one inspection unit being disposed to oppose the guide, wherein while running along the arc-shaped track portion, the sheet-shaped matter is inspected by the inspection unit under a guidance of the guide.

2. The quality inspection apparatus for a sheet-shaped matter according to claim 1, wherein, the at least one inspection unit includes a plurality of inspection units.

3. The quality inspection apparatus for a sheet-shaped matter according to claim 1, wherein the guide is a rotationally driven rotary guide body and the rotary guide body is configured to cause the sheet-shaped matter to stick to the circumferential surface by suction.

4. The quality inspection apparatus for a sheet-shaped matter according to claim 3, wherein the rotary guide body is rotationally driven by an exclusive driving unit.

5. The quality inspection apparatus for a sheet-shaped matter according to claim 3, further comprising:

adjustment means configured to adjust a circumferential speed of the rotary guide body.

6. The quality inspection apparatus for a sheet-shaped matter according to claim 4, further comprising:

sheet information inputting means configured to input various kinds of information on the sheet-shaped matter; and control means configured to control the driving unit on a basis of an input signal from the sheet information inputting means.

7. The quality inspection apparatus for a sheet-shaped matter according to claim 1, wherein the guide is a fixed suction guide having an arc-shaped suction surface in a part of its circumferential surface, and is configured to cause the sheet-shaped matter to stick to the arc-shaped suction surface by suction.

8. The quality inspection apparatus for a sheet-shaped matter according to claim 1, wherein:

the arc-shaped track portion is installed to be convex toward an inside of a loop formed by the movement track in order that the arc center of the arc-shaped track portion is positioned outside the loop;

the guide is installed outside the loop; and the inspection unit is installed inside the loop.

9. The quality inspection apparatus for a sheet-shaped matter according to claim 1, wherein:

the arc-shaped track portion is installed to be convex toward an outside of the loop formed by the movement track in order that the arc center of the arc-shaped track portion is positioned inside the loop;

the guide is installed inside the loop; and the inspection unit is installed outside the loop.

* * * * *